United States Patent [19]

Mott

[11] 4,234,047

[45] Nov. 18, 1980

[54] DISCONNECTABLE RISER FOR DEEP WATER OPERATION

[75] Inventor: George E. Mott, Metairie, La.

[73] Assignee: Texaco Inc., White Plains, N.Y.

[21] Appl. No.: 842,193

[22] Filed: Oct. 14, 1977

[51] Int. Cl.[3] ..... E21B 7/128

[52] U.S. Cl. ..... 175/5; 166/350; 166/359

[58] Field of Search ..... 175/7; 166/0.5, 0.6, 166/362, 365, 367, 359, 350

[56] References Cited

U.S. PATENT DOCUMENTS

| | | | |
|---|---|---|---|
| 2,512,783 | 6/1950 | Tucker | 175/7 X |
| 3,196,958 | 7/1965 | Travers et al. | 166/0.5 X |
| 3,336,572 | 8/1967 | Paull et al. | 166/0.5 X |
| 3,424,241 | 1/1969 | Triplett | 166/0.5 |
| 3,855,656 | 12/1974 | Blenkarn | 175/7 X |
| 3,999,617 | 12/1976 | Ilfrey et al. | 175/7 |
| 4,047,579 | 9/1977 | Wilckens et al. | 175/7 |
| 4,063,602 | 12/1977 | Howell et al. | 175/7 |

*Primary Examiner*—Ernest R. Purser
*Assistant Examiner*—Richard E. Favreau
*Attorney, Agent, or Firm*—Carl G. Ries; Robert B. Burns

[57] ABSTRACT

An offshore marine structure for drilling wells into the ocean floor including a floating vessel which carries the necessary drilling equipment. A riser which extends from the vessel to a well head at the ocean floor, encloses a drill string and permits circulation of the drilling mud and fluids. The riser is comprised of at least two detachably connectable segments, one of which can be moved with the floating vessel, while the other remains buoyantly in place until such time as the two segments are reconnected.

5 Claims, 7 Drawing Figures

FIG. 4
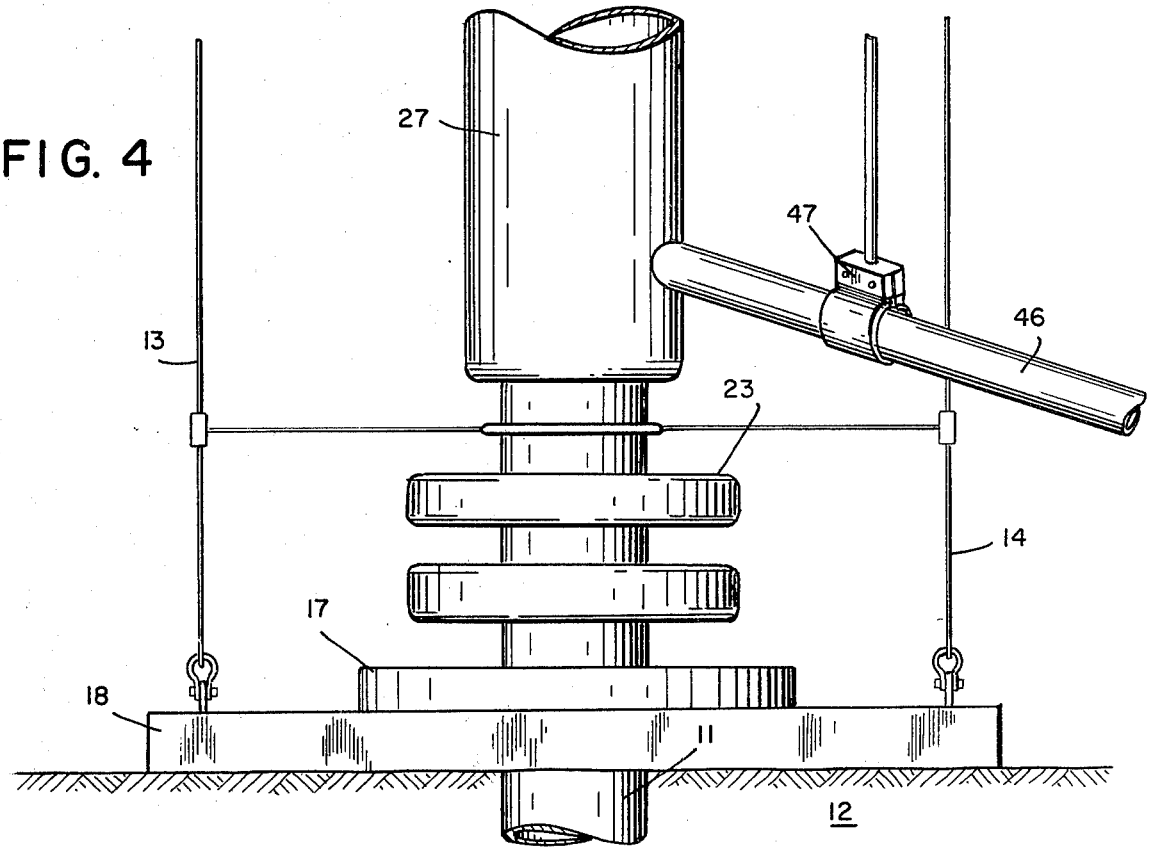
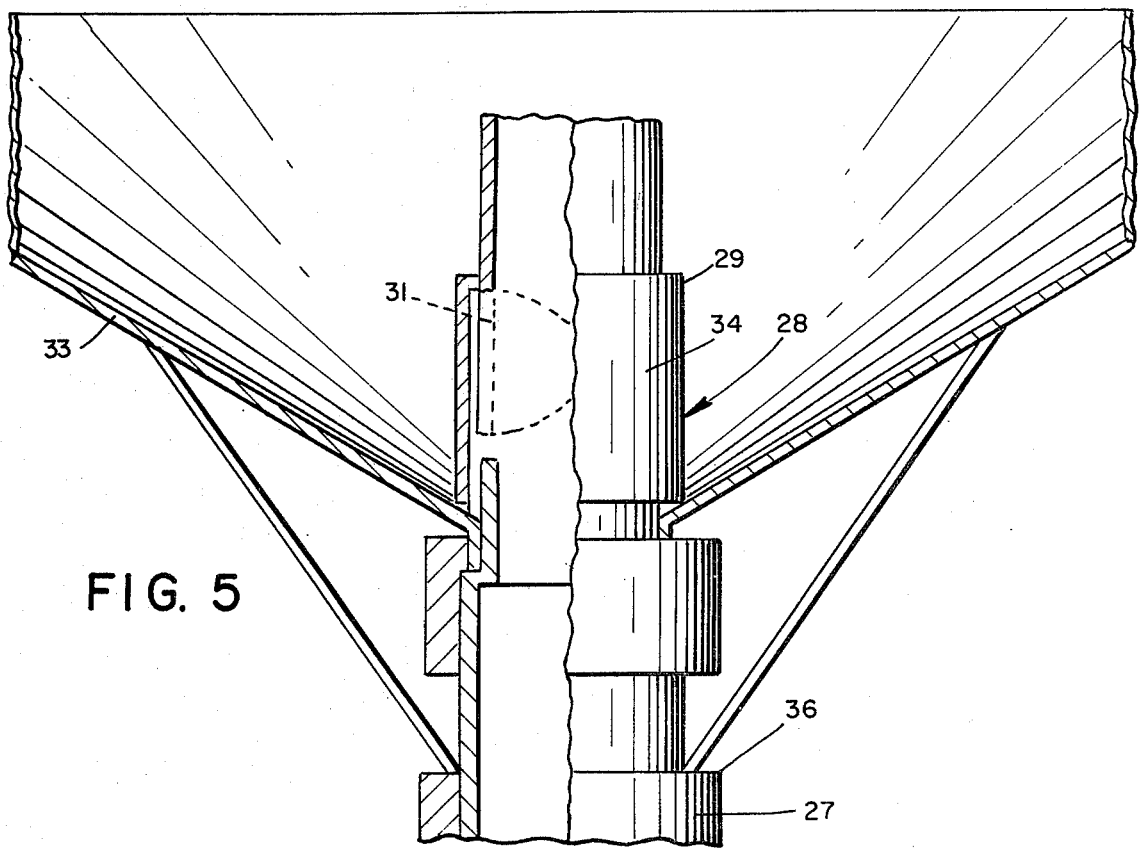
FIG. 5

DISCONNECTABLE RISER FOR DEEP WATER OPERATION

BACKGROUND OF THE INVENTION

In the drilling of wells from a vessel at an offshore location it is necessary that a riser or elongated conductor extend from the vessel to the ocean floor, being normally connected to the well head structure. The function of the riser is to enclose the drill string and permit circulation of the drilling mud and drilling fluids during a drilling operation. Normally the riser comprises a series of pipe-like elements which are sealably joined into an elongated single conduit.

It can be appreciated that in the instance of relatively deep waters, the riser can be subjected to extreme stresses. This normally results from the action of water currents and the movement of the drilling vessel at the water's surface.

For example, under certain circumstances the riser can be subjected to water currents in more than one direction. This action will induce a number of curves and stresses into the riser structure. The problem however can be minimized or even obviated by the use of suitable tensioning apparatus on the drilling vessel. Such apparatus functions to stress the riser to a predetermined degree so that the amount of physical deformation is minimized.

In relatively deep waters the necessary use of risers has imposed a number of problems which increase in intensity with water depth. However, where the waters are infested with floating masses, such as icebergs, thick ice floes, and the like, it can be appreciated that these problems are greatly amplified.

For example, in Northern waters where icebergs and ice floes are found to be prevalent, it is often necessary during a drilling operation to quickly move a drilling vessel out of the way of an iceberg. This is achieved after only limited notice of the presence of the iceberg. Thereafter, the vessel will return to its position after the iceberg has passed.

It is a relatively routine matter to detach any drilling vessel from its moorings to permit its being removed or displaced. However, the interruption of the actual drilling operation can be, and normally is a time consuming operation. Not only is such a procedure slow and methodical, it is also expensive from a producing consideration.

Initially, withdrawal of the drill string consumes a considerable amount of time, depending on the depth to which the well has been drilled. In addition, however, the riser must also be withdrawn and dismantled prior to the drill ship being moved.

Toward minimizing the time consumed, and the expense of such a deep water drilling operation, the present invention provides a system wherein a drilling vessel is connected at the ocean floor by way of a riser. The latter is provided with at least one remotely actuated connecting joint.

Functionally, the connecting joint is positioned in the riser structure several hundred feet (200'-500') below the water's surface in the instance of water depths in excess of about 1,000 to 1,500 feet. Thus, by uncoupling the riser at said joint, the upper segment can be displaced with the drill vessel while the lower segment remains substantially in place. The upper end of the detached segment is at a sufficient depth below the water's surface to be safe from damage as the iceberg or other mass floats above it.

It is therefore an object of the invention to provide an offshore well drilling system capable of being rapidly disconnected from a drilling site such that the vessel can be removed. A further object is to provide such a system which is capable of permitting the riser member to be rapidly disconnected under emergency conditions at a point below the water's surface so that at least part of the riser will be displaced and the remainder held uprightly in place. A still further object is to provide a drill riser of the type contemplated which is adapted to be disconnected at such time as the drilling vessel is removed, and is further adapted to be readily reconnected at such time as the drilling vessel returns to recommence a drilling operation.

DESCRIPTION OF THE DRAWINGS

FIG. 4 is an enlarged segmentary view of the lower end of the riser.

FIG. 5 is a segmentary view in partial cross section of the riser coupling section.

Referring to FIG. 1, a system of the type contemplated is shown in which a drilling vessel 10 is positioned at the water's surface and is adapted to drill a well bore 11 into the floor 12 of the ocean. The floating vessel 10 is shown as a tension leg type vessel, which is held in place by a series of vertical cables 13 and 14. Alternatively it can be maintained by catenary cables or can be dynamically positioned.

Figure 1:
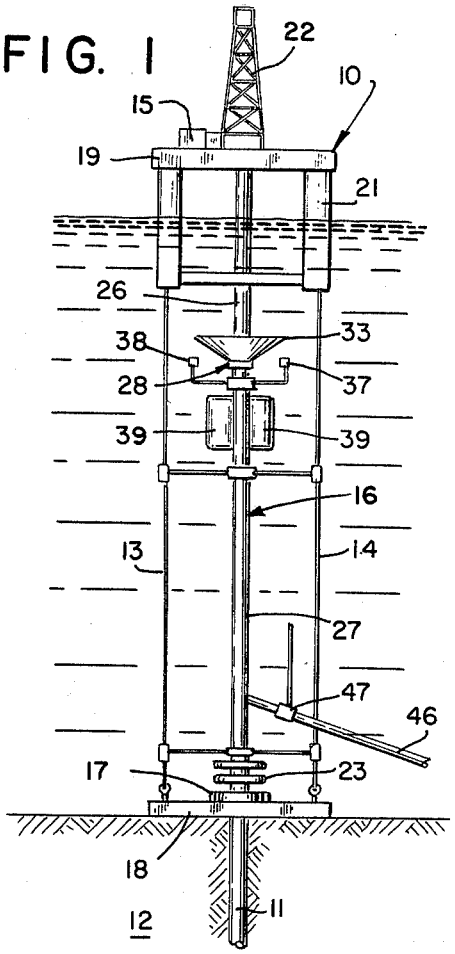
FIG. 1 is an elevational view of a floating offshore platform utilizing the instant riser system.
Figure 2:
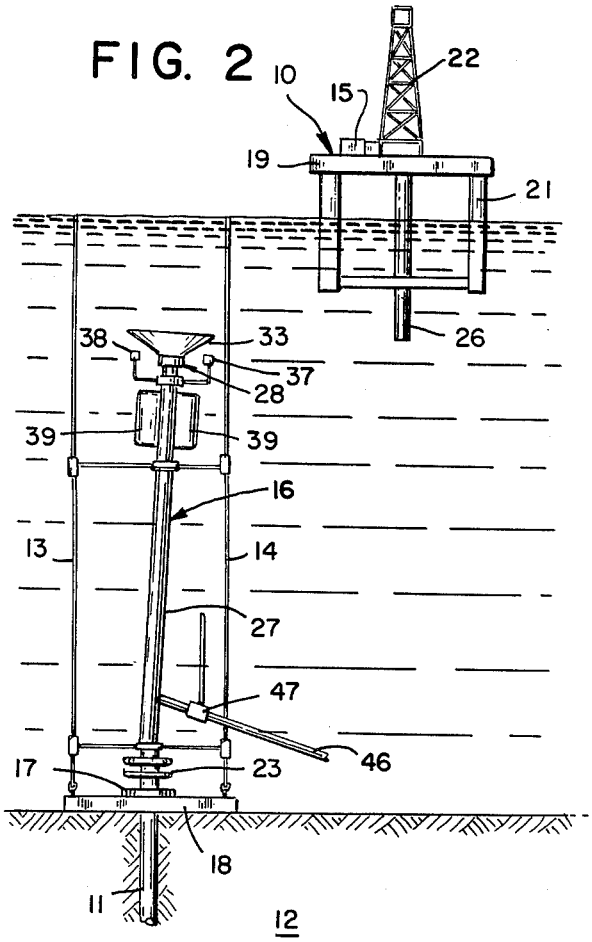
FIG. 2 is similar to FIG. 1 showing the riser in disconnect position.
Figure 3:
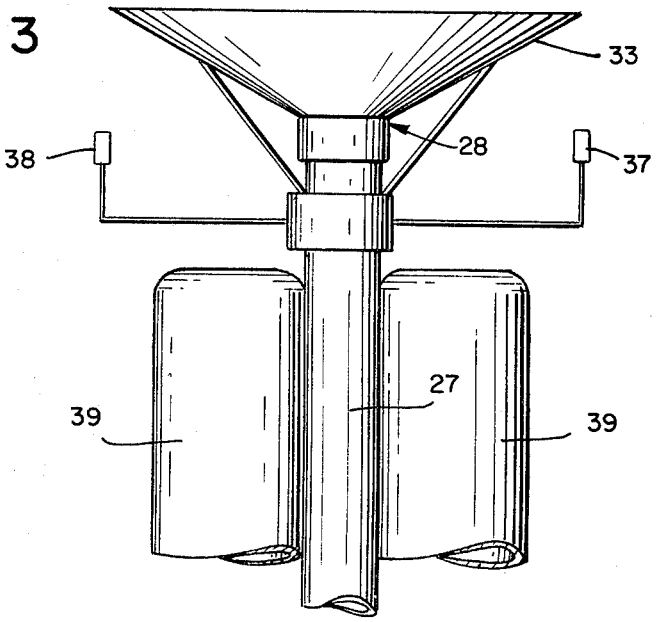
FIG. 3 is an enlarged view in partial cross section of the upper end of the riser connection.
Figure 6:
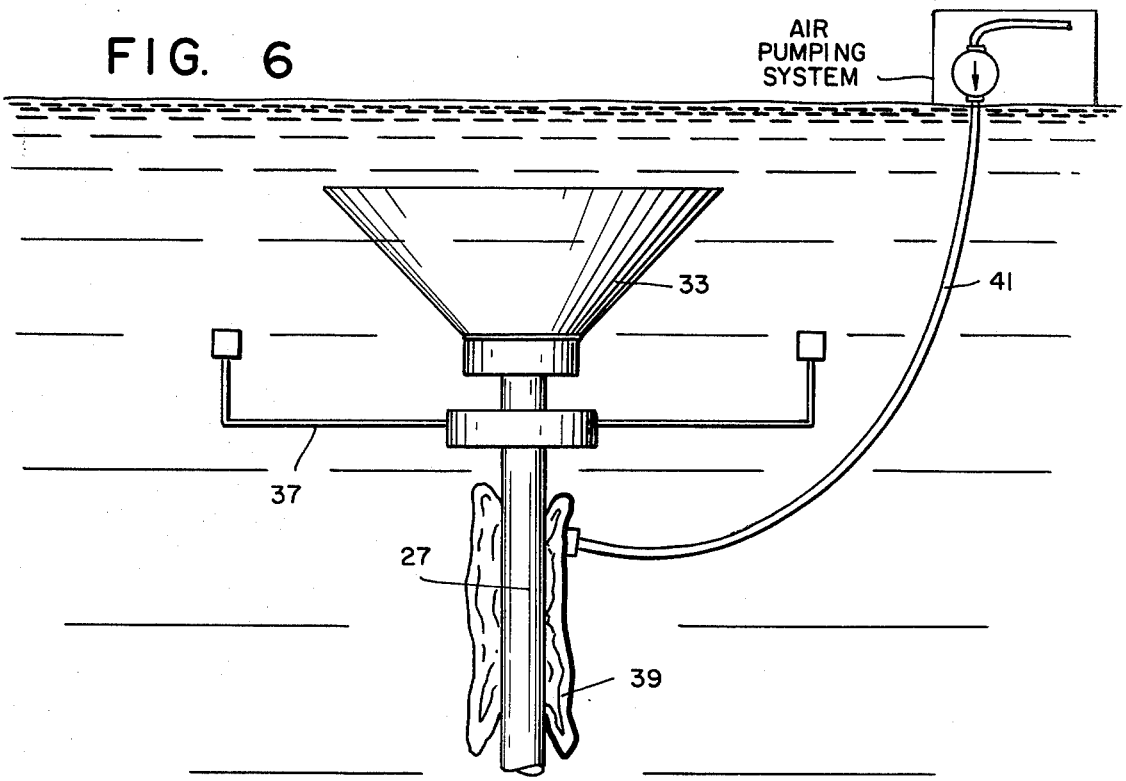
FIGS. 6 and 7 are partial views of the riser system using flexible buoyancy bags.
Figure 7:
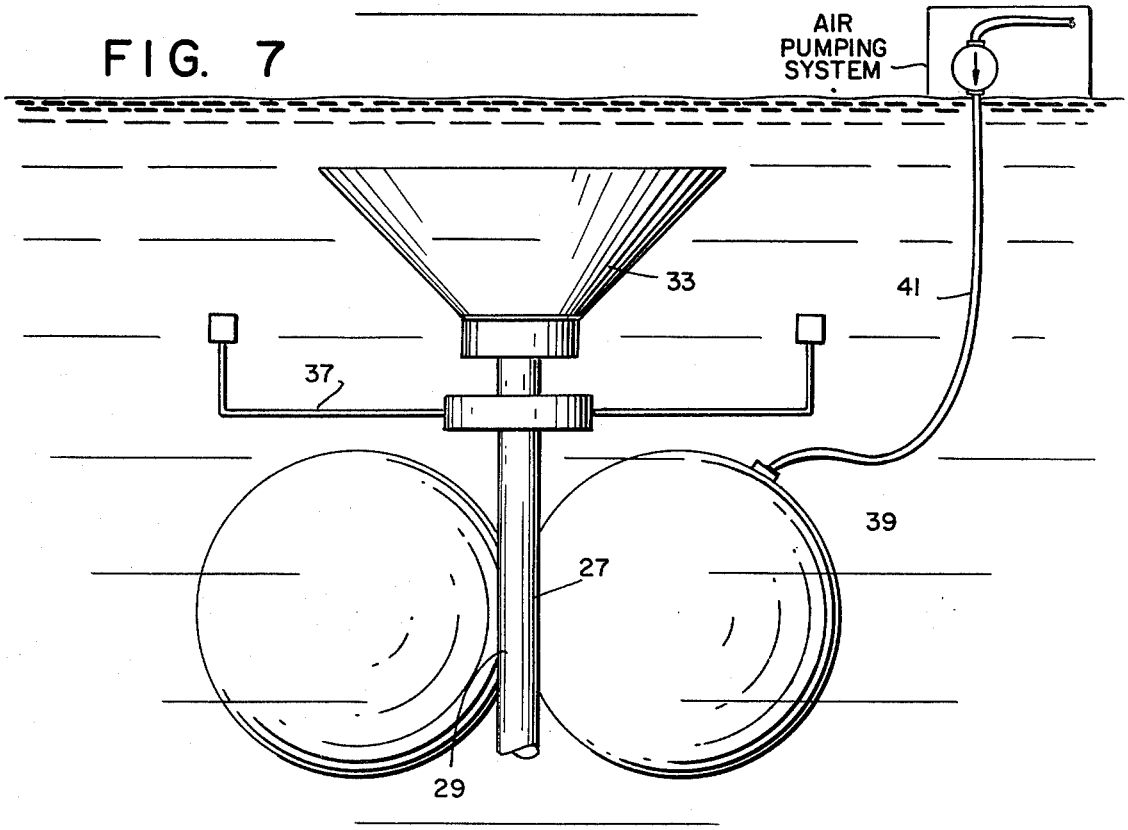

Vessel 10 supports an elongated riser member 16. The latter as shown is operably connected to the drilling vessel and extends downwardly in a substantially vertical disposition to be firmly connected to well head 17 at the ocean floor.

The drilling vessel 10 presently disclosed can be any one of a type normally in use as above noted for drilling offshore wells. The vessel shown is of the semisubmersible type, adapted for use in deep waters. However, other types of vessels, such as drill ships, may also be used with the suggested riser system. It is further advantageous in very deep water that such a vessel incorporate a tension leg type system with vertical cables or a dynamic positioning system, to maintain it in place at a preferred drilling depth.

The vessel is thus supplied with hold down cables 13 and 14 which are anchored to the ocean floor, to the well head 17 or to foundation 18, or with similar station keeping means. While the present hold down cables are shown in a generally vertical orientation it can be appreciated that depending on the particular drilling site, vessel 10 can be subjected to natural forces that cause it to be displaced from above well head 17 even though the hold down cables are fully tensioned.

It is further noted that although hold down cables 13 and 14 are here used, vessel 10 can likewise be provided with a suitable dynamic positioning system which has no mooring connection to the ocean floor. With such a system riser 16 is the only physical tie between vessel 10 and the ocean floor.

The drilling vessel as shown comprises a working deck 19 having a plurality of upright buoyant columns 21 which are mutually connected to a buoyant base. Deck 19 supports the normal drilling derrick 22 and rotary, together with other necessary equipment for accomplishing drilling of well bores at an offshore location.

Drilling vessel 10 is provided with means to operably engage, and support the upper end of the riser 16. Such support is normally required since the vessel, although being downwardly tensioned by hold down cables 13 and 14, will nonetheless be subject to a certain degree of translatory motion. Riser 16 can further be provided with a stabilizing system such as a dynamic tensioning arrangement which is operable to hold riser 16 in a relatively vertical orientation.

Riser stabilizing systems are common to the industry and are so designed to compensate for any movement of vessel 10. The stabilizer's action will thus neutralize the condition of the riser and/or the drill string without imposing undue strain on either member.

Submerged well head 17 is presently shown as comprising a base or foundation 18 which is fastened into the ocean floor by piles or mass anchors. Foundation 18 supports the necessary equipment usually carried at the ocean floor to accommodate a well drilling operation. Such equipment comprises primarily sufficient valving to regulate the drilling operation, together with a blowout preventer assembly to facilitate the operation. In either instance, the lower end of elongated riser 16 will firmly engage the blowout preventer 23 whereby to permit a seal therebetween to facilitate the flow of drilling fluids.

Further, in water depths up to approximately 1,000 feet the shown system can be provided with additional guidelines adapted to extend between well head 17 and vessel 10. These guidelines, although not specifically shown, permit the controlled lowering and withdrawal of the blowout preventer or other equipment as the case may be, or as the need might arise. In the present arrangement the vessel hold down cables 13 and 14 are shown as simulating guidelines which would function as above noted. In practice, another set of guidelines would be provided to run the blowout preventer stack and other ancillary equipment.

Riser 16 as shown, is fixed at its lower end to the blowout preventer 23 and is operably fixed at its upper end to the vessel 10 heave compensator. Structurally, riser 16 comprises a series of discrete, end connected tubular members. Physically, the discrete members are sequentially put together as the riser is gradually lowered to well head 17. When completed, riser 16 in effect defines an elongated continuous passage or conduit which extends between drilling vessel 10 and the well bore 11.

Operationally, riser 16 functions to conduct drilling mud which has been pumped from a mud pump 15 down the drill string, not shown, into the borehole 11, up back to the vessel 10. This of course is a procedure normally followed in any offshore well drilling system.

Riser 16 when assembled, is comprised of at least two distinct elements; upper segment 26 and lower segment 27. Said segments are disconnectably engaged at a coupling joint 28 normally located 200 to 300 feet below the water's surface. Generally, joint 28 is located at a depth at which it is determined that the upper end of the lower riser segment 27 will be clear of icebergs which are expected to flow through the area. The coupling member joint 28 as shown includes a remotely controlled actuating means 29 whereby the two engaging ends of the respective upper and lower segments can be brought into a sealed relationship.

There are a number of such pipe or conduit connectors such as 28, which are well known and used in the industry. Said units are so arranged that upper and lower members 34 and 36 can be remotely connected. Further, they are usually guidably brought into engagement through the use of guide cables or the like.

The upper end of lower segment 27 is provided with means for simplifying the re-uniting and connecting of the respective riser segments. Thus, said lower segment 27 is provided with a funnel-like arrangement 33. The guide funnel is so contoured that the lower constricted end will engage the descending upper riser segment 26, and physically guide it into its proper position in the lower coupling segment 36. Alternatively, a conventional guideline system can be installed on a frame near the top of lower riser 27, which system would guide the drill pipe, tools, etc. into the well bore as required.

While not presently shown, means for facilitating the re-uniting or alignment of the two separated riser segments prior to coupling, can be by a propulsion arrangement connected to upper segment 26. Such a unit usually functions through one or more water jets which are adapted to controllably urge the riser upper segment into a desired lateral direction. Thus, by regulating the outflow of jetting fluid, riser segment 26 can be laterally regulated as it descends.

Further, toward achieving the desired realignment of the respective riser segments 26 and 27, one or both parts can be provided with a guidance system. Such an arrangement can include remotely actuated transponders 37 and 38 or passive transponders. The former are capable of being remotely actuated to transmit signals receivable at the vessel 10. Thus, the location of riser segment 27 coupling can be accurately determined at the water's surface.

Functionally, the transponder system operates in response to a signal originating from vessel 10. An electronic signal is then transmitted upwardly to be received on the vessel by suitable instrumentation whereby the vessel can be displaced or adjusted to permit accurate alignment of the riser segment.

A further characteristic of riser member 16 is that it is normally so structured with hollow walls or with other means of buoyancy that it is at least partially buoyant. This buoyancy feature is essential in deep water, because the weight of the riser and drilling fluids may exceed the riser tensioning capacity which is feasible to install on the rig.

In order to compensate for the upward pull exerted by the drilling vessel 10 at the time the latter is displaced, lower segment 27 of the riser can be provided with provisional, supplementary buoyant means. The latter is actuated or properly positioned only at such time as it is required.

In one embodiment, the supplementary buoyancy means can comprise a series of tanks 39 fixedly positioned to riser 27 upper end. The tanks are communicated with the water's surface whereby buoyancy of the tank or tanks can be easily controlled. As shown, tanks 39 can be rigid walled members which are permanently fixed to the lower riser 27 upper end and fixed thereabout. Further, each tank is communicated with vessel 10 by a valved conduit. Although not presently shown, such conduits for underwater use are well known in the art. The conduit is further communicated with a source of air or compressed gas at the water's surface. The air is normally precompressed in tanks, or compressed directly in a compressor and delivered to the underwater tank 39. Such ballasting and deballasting systems and equipment have long been in use in underwater operations such as diving and the like. The respective tank or tanks 39 can then be ballasted as needed, or evacuated to exert a maximum upward pull on riser segment 27 during a disconnect operation.

In another embodiment of the invention, provisional buoyancy means can comprise a series of collapsible, flexible walled tanks which are retained about riser 27 in a collapsed or deflated condition. The respective tanks are then actuated to an expanded condition during a disconnect operation. A tank or tanks of this type comprise sufficiently flexible walls that the latter, when deflated, will be urged closely about riser 16 lower segment 27 and thereby minimize the water flow resistance of the riser.

Tanks 39 are communicated with pumping system at the water's surface. At commencement of a riser disconnect operation, the flexible walled tanks, are normally compressed by water pressure against the outer walls of riser 16. Said tanks are then expanded with air or a similar inflating medium. The tanks in such condition will provide an additional buoyant force at the riser upper end which is necessary to maintain the substantially vertical disposition of segment 27, after being disconnected from upper riser segment 26.

It is appreciated that to be able to initially run the riser without adding weight the unit must be at least slightly negatively buoyant. Usually the flotation material is provided in the riser structure to provide 95% to 98% buoyancy. After running the riser the shipboard tensioners are applied to maintain inner tension.

When on the other hand upper riser segment 26 becomes disconnected from the lower riser 27 and vessel 10 is moved off location, it is first necessary to make the riser buoyant by deballasting tanks 39 or by inflating the flexible walled buoyancy bags. As mentioned, when rigid wall tanks are utilized, these can be similarly filled with air to increase their buoyant capabilities.

To lessen the weight of upper riser segment (26) and to conserve drilling fluid, valve (31) is provided at the lower end of said riser segment (26). The function of this member is to form a controllable closure across the segment (26) lower end and to regulate the amount of drilling fluid retained therein. Said closure member is remotely operated from the surface and can be formed of a series of flapper members which depend from the inner wall of the riser segment and can be automatically adjusted to closed position.

Said member (31), however, can also comprise a resilient walled, inflatable unit which is connected to a source of an inflating medium at the water's surface. Thus, at such time as it becomes necessary to make a disconnect between the riser segments, said member (31) is inflated as to define a closure across the lower open end of segment (26), and thereby regulate the weight of said member (26).

Next, a remotely operated valve 47 near the bottom of the lower riser and communicated with the interior thereof, is opened to allow mud to drain from the riser and equalize to the exterior water pressure. At this point, coupling 28 is remotely actuated and the separation effected by raising a part of the upper riser into vessel 10. The latter can then be towed or moved by its own power to a safe area until the ice peril has passed.

To minimize stress on the free standing riser segment 27, means is provided for rapidly evacuating or draining mud from the riser lower segment. Said lower segment is thus provided with a valved conduit means 46 which is communicated with and which extends from the riser 27 lower end. When valve 47 is remotely actuated to the open position, mud or other heavy drilling fluid is drained at a controllable rate onto the ocean floor. Concurrently, water will enter the upper end of said segment. The overall result will be that the integrity of the riser segment is sustained, and its center of gravity is moved toward the bottom of the column.

Although the drilling fluid or mud is considered as lost, the expense is readily justified if the vessel and the riser are preserved and can be readily united to continue a drilling operation.

Other modifications and variations of the invention as hereinbefore set forth can be made without departing from the spirit and scope thereof, and therefore, only such limitations should be imposed as are indicated in the appended claims.

I claim:

1. In an offshore system for drilling well bores through a well head in the ocean floor, and which includes;

a drilling vessel floatably positioned at the water's surface, an elongated riser extending between, and connected at its opposed ends to the vessel and to the said well head whereby to define an elongated continuous passage therethrough, pumping means on said vessel communicated with said riser for circulating a flow of drilling fluid therethrough during a well drilling operation, and opening means in said riser upper end for passing a rotating drill string through said riser to form said well bore in the ocean floor, the improvement therein of;

said riser including separable upper and lower segments, remotely actuated coupling means being operable to removably engage said upper and lower segments to form said continuous passage, and buoyancy means positioned on said riser lower segment to externally support said lower segment whereby to maintain the latter in a substantially upright position when said lower segment has disengaged from the riser upper segment and regulating means for controlling the amount of drilling fluid which is retained in said riser upper and lower segments respectively during a disconnect of said segments.

2. In an apparatus as defined in claim 1, wherein said buoyancy means includes at least one rigid walled tank operably engaged with said lower riser segment.

3. In an apparatus as defined in claim 1, including; buoyancy control means communicating said buoyancy means with a source of a filling medium at the water's surface.

4. In an apparatus as defined in claim 3, wherein said buoyancy means includes a flexible walled inflatable member depending from said lower riser segment.

5. In an offshore system for drilling well bores through a well head, into the ocean floor and which includes;

a drilling vessel floatably positioned at the water's surface, an open ended elongated riser extending between and connected at its respective opposed ends to the vessel and to the said well head whereby to define an elongated continuous passage therethrough, pumping means on said vessel for circulating a flow of drilling fluid down a drill string and through the riser during a well drilling operation, and means in said riser upper end for controllably passing a rotating drill string through said riser to form said well bore in the ocean floor, the improvement therein of, said riser including separable, discrete upper and lower segments, coupling means being operable to removably engage said upper and lower segments one to the other to form said continuous passage therethrough, and a mud conduit means communicated with said lower riser segment and being operable to discharge drilling fluid therefrom, and closure means disposed in said riser upper segment, being remotely operable to form a closure across the lower end of said elongated passage to retain drilling fluid in the latter.

* * * * *